US006078769A

United States Patent [19]

Fraser et al.

[11] Patent Number: 6,078,769

[45] Date of Patent: Jun. 20, 2000

[54] CYLINDER FOR A PRINTING MACHINE

[75] Inventors: Kenneth D. Fraser, Scarborough; Peter Taylor, Brooklin, both of Canada; Steve Cormier, Leominster, Me.

[73] Assignee: Heidelberger Druckmaschinen Aktiengesellschaft, Heidelberg, Germany

[21] Appl. No.: 09/136,106

[22] Filed: Aug. 18, 1998

[30] Foreign Application Priority Data

Aug. 18, 1997 [DE] Germany ..... 197 35 765

[51] Int. Cl.[7] ..... G03G 15/08

[52] U.S. Cl. ..... 399/279; 399/286; 492/18; 492/47

[58] Field of Search ..... 399/286, 279, 399/159, 117, 119, 265, 331, 333; 492/2, 7, 18, 21, 47; 219/469, 470

[56] References Cited

U.S. PATENT DOCUMENTS

| | | | |
|---|---|---|---|
| 4,974,782 | 12/1990 | Nelson | 355/27 |
| 5,289,237 | 2/1994 | Hashizume et al. | 399/284 |
| 5,420,664 | 5/1995 | Miwa et al. | 399/167 |
| 5,697,035 | 12/1997 | Mashtare et al. | 399/328 X |
| 5,802,443 | 9/1998 | Matsumoto et al. | 399/333 |
| 5,887,237 | 3/1999 | Matsumoto et al. | 399/333 |

OTHER PUBLICATIONS

Webster's Ninth Collegiate Dictionary, p 173, copyright 1986.

*Primary Examiner*—William J. Royer
*Attorney, Agent, or Firm*—Kenyon & Kenyon

[57] ABSTRACT

A cylinder (2) for a printing machine, particularly a developing cylinder in an electrographic printing machine, having a rigid, elongated shaft body (10) and a rigid hollow body (11) whose exterior forms the covering and the top and bottom surfaces of the cylinder. In order that, during operation under constant conditions, the cylinder can roll properly against another rigid cylinder of the printing machine, flat sides (12,13) of the hollow body (11) which form the top and bottom surfaces of the cylinder, have centrical bore holes that are larger than the diameter of the shaft body (10) in the area of the flat sides. Located in the space between the shaft body and the flat sides of the hollow body is an elastic material (14,15) which joins the flat sides of the hollow body to the shaft body. Inside the hollow body, in the center between the flat sides of the hollow body one or a plurality of braces (16) are arranged which extend transversely to the figure axis of the shaft body, and which firmly join the hollow cylindrical covering of the hollow body to the shaft body, so that the figure axis of the hollow body and the figure axis of the shaft body coincide in a normal state, and intersect at a small angle under the influence of outer forces.

12 Claims, 1 Drawing Sheet

CYLINDER FOR A PRINTING MACHINE

FIELD OF THE INVENTION

The present invention relates to a cylinder for a printing machine, and more particularly to a cylinder having a rigid, elongated shaft body, and a rigid hollow body whose exterior forms the covering and the sides of the cylinder.

RELATED TECHNOLOGY

With the development of printing machines on the basis of electrographic processes, the demands on the rotational accuracy and smoothness of machine cylinders have risen sharply. An electrographic printing machine contains a movable image carrier, which in many cases is a rotating cylinder such as a photo-conductor drum or a drum having a plurality of microcells insulated relatively to each other, the microcells being able to be charged individually, controlled by a processor.

Arranged at the periphery of the image cylinder are various stations for the electrographic process, to which belongs a developing station. The developing station is likewise frequently a rotating cylinder. During the developing process, first of all toner from a reservoir is applied onto the developing cylinder. The developing cylinder, via a more or less narrow gap, adjoins the image cylinder. In the gap, the toner is transferred from the developing cylinder to the image cylinder. The width of the gap depends upon the development method used. In the "gap development" method, the gap width is several times the average diameter of the toner particles, and the toner particles jump over the gap between the image cylinder and the developing cylinder. In the "contact development" method, the developing cylinder contacts the image cylinder. Intermediate forms of these developing techniques are additionally possible.

In the case of contact development, generally one of the mutually contacting cylinders is flexible, and nestles into the other cylinder, thus compensating for possible cylinder irregularities and concentricity errors. If, for technical reasons, the image cylinder must be rigid, generally an elastic developing cylinder is used. However, for reasons of higher resistance to wear, or in order to be able to use special techniques for producing the toner layer on the developing cylinder, it can be desirable for the developing cylinder to be rigid as well. Especially in the case of contact development, the demands with regard to the smoothness and rotational accuracy of the image cylinder and of the developing cylinder are then extremely high, and moreover, are all the higher, the finer the toner is. These demands are exceedingly difficult to meet using conventional means.

SUMMARY OF THE INVENTION

An object of the present invention is to provide an essentially rigid cylinder for a printing machine, the cylinder being simply constructed. The cylinder also is capable, in operation under constant conditions, of rolling properly against another rigid cylinder of the printing machine.

The present invention therefore provides a cylinder having a rigid elongated shaft body and a rigid hollow body whose exterior forms the covering and first and second side surfaces. The flat sides of the hollow body, which form the first and second side surfaces of the cylinder, have centrical bore holes that are larger than the diameter of the shaft body in the area of the flat sides. In the space between the shaft body and the flat sides of the hollow body, an elastic material is arranged which joins the flat sides of the hollow body to the shaft body, and, inside the hollow body, in the center between the flat sides of the hollow body, one or a plurality of braces are arranged which extend transversely to the figure axis of the shaft body. The braces firmly join the hollow cylindrical covering formed by the hollow body to the shaft body, so that the figure axis of the hollow body and the figure axis of the shaft body coincide in a normal state, and intersect at a small angle under the influence of outer forces.

Since the cylinder position is fixed exactly by the brace or braces in the center, a very uniform rolling behavior in relation to a second cylinder can be achieved. Nevertheless, the elastic material at the sides allows a compensation for rotational inaccuracies of the cylinder and/or of the adjoining cylinder, particularly a compensation of axial precession movements, a relatively frequent radial eccentricity.

One special advantage of the present invention is that compensating movements do not have an effect on the clearance to a third cylinder, which is arranged in a 90°-position with respect to the second cylinder, at the periphery of the first cylinder.

In one preferred specific embodiment of the present invention, the elastic material has, moreover, vibration-damping properties, so that it brings the hollow body from a state in which the figure axis of the hollow body and the figure axis of the shaft body do not coincide with each other, back very quickly into the normal position. For example, a foam-like material has such properties. The type and the arrangement of the material can be so selected that deflections of the hollow body relative to the shaft body are brought back quickly, and without overshooting, into the normal position, i.e. vibrational damping takes place in the aperiodic borderline case.

The elastic material preferably forms two ring-shaped, elastic bodies which are put on the shaft body, one of these bodies being arranged in each case in the two centrical bore holes in the flat sides of the hollow body.

Preferably a brace in the form of a disk having a hole in the middle is used, the outside diameter of the disk corresponding to the inside diameter of the hollow cylindrical covering of the hollow body, and the inside diameter of the disk corresponding to the outside diameter of the shaft body.

The present invention is suited, for example, for a developing cylinder for contact developing in the developing station of an electrographic printing machine, but also for other printing-machine cylinders for which special demands on the rotational accuracy must be met.

BRIEF DESCRIPTION OF THE DRAWINGS

An exemplary embodiment of the present invntion is explained below with reference to the drawings, in which.

DETAILED DESCRIPTION

Figure 1:
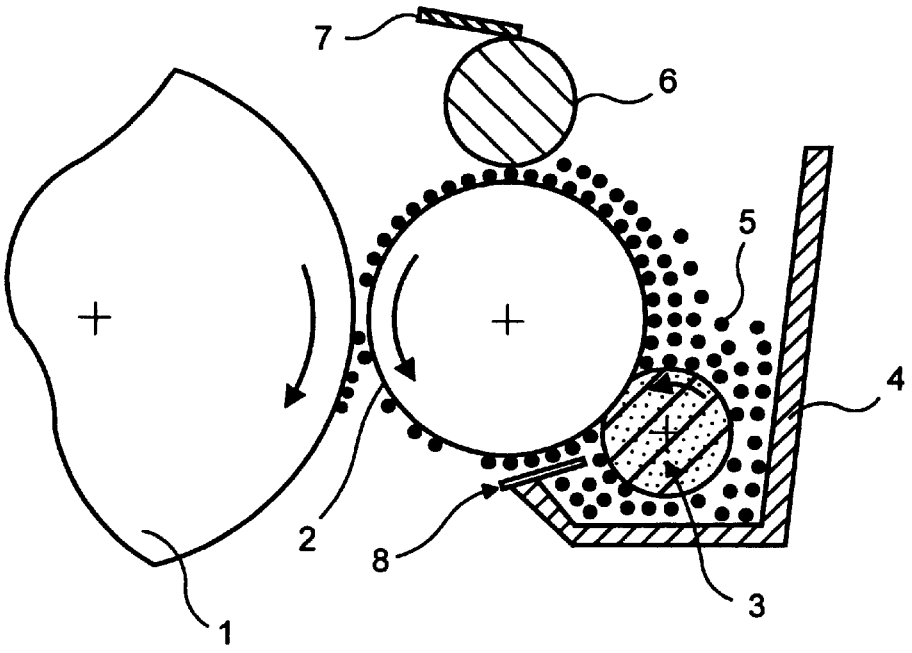
FIG. 1 shows a sectional view of a developing station for contact developing.

FIG. 1 shows a developing station or an inking unit for a printing machine for developing an electrostatic charge pattern on a rotating, rigid image cylinder 1 of the printing machine with a single-component toner. Supported axially parallel to image cylinder 1 is a rotating, rigid developing cylinder 2. Developing cylinder 2 is made of metal, typically aluminum, with a wear-resistant, outer coating. A rotating replenishing roll 3, made of a foam-like material, is supported axially parallel to developing cylinder 2. Replenishing roll 3 is firstly in communication with a toner reservoir 4, in which it is densely surrounded by toner particles 5, and secondly it presses against developing cylinder 2 and is compressed at the point of contact.

Supported axially parallel above developing cylinder 2, at a very small distance to developing cylinder 2, is a rotating, rigid doctor roll 6 made of metal. Doctor roll 6 likewise has a wear-resistant surface. The gap between the surfaces of developing cylinder 2 and doctor roll 6 is somewhat larger than the diameter of toner particles 5 (shown extremely enlarged in the Figure). Arranged above doctor roll 6 is a rubber doctor blade 7 which presses flexibly against doctor roll 6. In addition, a sealing lip 8 is mounted between toner reservoir 4 and developing cylinder 2, to prevent toner particles 5 from escaping from toner reservoir 4 at this location.

During operation, image cylinder 1, developing cylinder 2, replenishing roll 3 and doctor roll 6 are rotated in the directions indicated with arrows in FIG. 1, image cylinder 1 and developing cylinder 2 rotating with the same circumferential speed, and doctor roll 6 rotating with a substantially lower circumferential speed than developing cylinder 2.

Toner particles 5, which are non-conducting and non-magnetic, discrete particles having a typical size of approximately 5 to 15 $\mu$m, are largely electrically neutral within toner reservoir 4. Toner particles 5 are transported to developing cylinder 2 by rotating replenishing roll 3, and become electrostatically charged due to the friction developing in so doing. Because of the electric charge, toner particles 5 adhere by way of mirror charges to electrically conductive developing cylinder 2.

Developing cylinder 2 transports toner particles 5 in several layers upward to doctor roll 6. There, only a limited number of toner particles 5 can pass the narrow gap between developing cylinder 2 and doctor roll 6. In this exemplary embodiment, the gap is only a little wider than the diameter of the toner particles, precisely one layer of toner particles 5 passing the gap between developing cylinder 2 and doctor roll 6.

Toner particles 5, which have passed the gap between developing cylinder 2 and doctor roll 6, are then drawn into the actual developing area in which image cylinder 1 and developing cylinder 2 come into contact. Toner particles 5, which come in contact with charged image areas of image cylinder 1, remain stuck thereon, so that the electrostatic, latent image on image cylinder 1 is developed.

Figure 2:
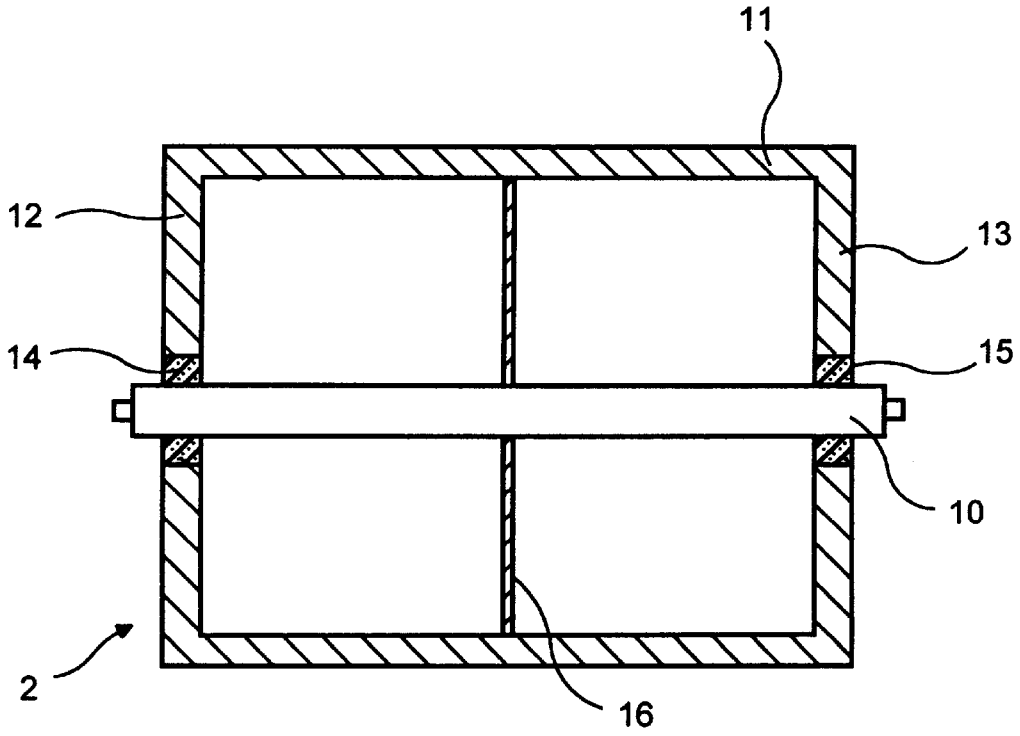
FIG. 2 shows a longitudinal section through the developing cylinder of the developing station of FIG. 1.

In FIG. 2, developing cylinder 2 is shown in a longitudinal section. Developing cylinder 2 contains a rigid, elongated shaft body 10 and a rigid hollow body 11, whose exterior forms the covering and the top and bottom surfaces of developing cylinder 2. Flat sides 12 and 13 of the hollow body, which form the top and bottom surfaces of the cylinder, contain centrical bore holes that are somewhat larger than the diameter of shaft body 10 in the area of flat sides 12,13. Shaft body 10 extends through the bore holes in flat sides 12 and 13. Located in each case in the space between shaft body 10 and flat sides 12 and 13, respectively, of hollow body 11 is a ring 14, 15, made of a foam material, which is securely joined to shaft body 10 and to the inside of the respective bore hole in sides 12 and 13. Rings 14 and 15 support hollow body 11 flexibly on shaft body 10.

In the interior of hollow body 11, arranged in the center between flat sides 12,13 of hollow body 11, is a round disk 16 made of sheet metal which has a hole in the middle. Disk 16 extends transversely to the figure axis of shaft body 10. The outside diameter of disk 16 is identical to the inside diameter of the hollow cylindrical covering formed by hollow body 11, and its inside diameter is identical to the outside diameter of shaft body 10. Disk 16 is joined inside to shaft body 10, and outside to hollow body 11. In this manner, disk 16 retains the axial center of the hollow cylindrical covering of hollow body 11 centrically on shaft body 10.

Given a developing cylinder 2 having this construction, under the influence of outer forces, the figure axis of hollow body 11 can tilt somewhat with respect to the figure axis of shaft body 10. This permits a compensation of radial eccentricities, particularly precessions, when developing cylinder 2 rolls against image cylinder 1 (FIG. 1). Since hollow body 11 is firmly joined in its axial center to shaft body 10, the pressure in the developing zone between image cylinder 1 and developing cylinder 2 remains essentially constant when image cylinder 1 and developing cylinder 2 roll against each other. Because of this, contact development can be carried out even with cylinders 1,2 which are rigid and hard on the outside.

As can be recognized from FIG. 1, compensating movements of developing cylinder 2 relative to image cylinder 1 have no measurable effects on the width of the gap between developing cylinder 2 and doctor roll 6, since the doctor roll is arranged in a 90°-position in relation to image cylinder 1. A suitably selected self-damping of the foam material of rings 14,15 assures that an inclination of developing cylinder 2 in relation to image cylinder 1 is present only in the direction of the connecting line of image cylinder 1 and developing cylinder 2, and, transversely to it, disappears, even when cylinders 1,2 are rotating very rapidly. In this manner, the width of the gap between rigid developing cylinder 2 and rigid doctor roll 6 is very precisely defined, in spite of the flexibility of developing cylinder 2 in relation to image cylinder 1, and a very uniform toner layer can be maintained on developing cylinder 2.

What is claimed is:

1. A cylinder for a printing machine comprising:

a rigid, elongated shaft body having a shaft axis and a shaft body diameter;

a rigid hollow body having a hollow body axis, the hollow body forming a cylindrical covering and two flat sides, the flat sides having centrical bore holes larger than the shaft body diameter in an area of the flat sides;

an elastic material located in a space between the shaft body and the flat sides, the elastic material joining the flat sides to the shaft body; and at least one rigid brace arranged centrally inside the hollow body between the two flat sides, the at least one rigid brace extending transversely to the shaft axis and firmly joining the cylindrical covering to the shaft body, so that the hollow body axis and the shaft axis coincide in a normal state and intersect at a small angle under an influence of outer forces.

2. The cylinder as recited in claim 1 wherein the elastic material has vibration-damping properties, so that the hollow body axis and the shaft axis return to a normal position without overshooting after the influence is removed.

3. The cylinder as recited in claim 1 wherein the elastic material is a foam-like material.

4. The cylinder as recited in claim 1 wherein the elastic material forms two ring-shaped, elastic bodies surrounding the shaft body, each ring-shaped, elastic body being arranged in one of the two centrical bore holes.

5. The cylinder as recited in claim 1 wherein the at least one rigid brace is in a shape of a disk with a hole in the middle, an outside diameter of the disk corresponding to an inside diameter of the cylindrical covering and an inside diameter of the disk corresponding to the shaft body diameter in the area of the disk.

6. The cylinder as recited in claim 1 wherein the cylinder is a developing cylinder of an electrographic developing station for contact developing.

7. A printing machine comprising:

a cylinder, the cylinder including:

a rigid, elongated shaft body having a shaft axis and a shaft body diameter, a rigid hollow body having a hollow body axis, the hollow body forming a cylindrical covering and two flat sides, the flat sides having centrical bore holes larger than the shaft body diameter in an area of the flat sides, an elastic material located in a space between the shaft body and the flat sides, the elastic material joining the flat sides to the shaft body, and at least one rigid brace arranged centrally inside the hollow body between the two flat sides, the at least one rigid brace extending transversely to the shaft axis and firmly joining the cylindrical covering to the shaft body, so that the hollow body axis and the shaft axis coincide in a normal state and intersect at a small angle under an influence of outer forces; and two further cylinders separated from each other at an angle of 90° relative to the shaft axis.

8. The printing machine as recited in claim 7 wherein the elastic material has vibration-damping properties, so that the hollow body axis and the shaft axis return to a normal position without overshooting after the influence is removed.

9. The printing machine as recited in claim 7 wherein the elastic material is a foam-like material.

10. The printing machine as recited in claim 7 wherein the elastic material forms two ring-shaped, elastic bodies surrounding the shaft body, each ring-shaped, elastic body being arranged in one of the two centrical bore holes.

11. The printing machine as recited in claim 7 wherein the at least one rigid brace is in a shape of a disk with a hole in the middle, an outside diameter of the disk corresponding to an inside diameter of the cylindrical covering and an inside diameter of the disk corresponding to the shaft body diameter in the area of the disk.

12. The printing machine as recited in claim 7 wherein the cylinder is a developing cylinder of an electrographic developing station for contact developing.

* * * * *